United States Patent [19]

Wear

[11] 4,009,669

[45] Mar. 1, 1977

[54] KNIFE BLOCK FOR TUFTING MACHINES

[75] Inventor: John H. Wear, Calhoun, Ga.

[73] Assignee: The Singer Company, New York, N.Y.

[22] Filed: May 6, 1976

[21] Appl. No.: 683,862

[52] U.S. Cl. ..... 112/79 R

[51] Int. Cl.[2] ..... D05C 15/24

[58] Field of Search ..... 112/79 R, 79 A, 262, 112/266, 410, 411, 78, 252; 83/700

[56] References Cited

UNITED STATES PATENTS

| | | | |
|---|---|---|---|
| 3,216,382 | 11/1965 | Wittler | 112/79 R |
| 3,277,852 | 10/1966 | Card | 112/79 R |
| 3,386,398 | 6/1968 | Cobble et al. | 83/700 |
| 3,604,379 | 9/1971 | Cobble | 112/79 R |

*Primary Examiner*—H. Hampton Hunter
*Attorney, Agent, or Firm*—Edward L. Bell; Robert E. Smith; Alan Ruderman

[57] ABSTRACT

A knife block for mounting at least three cutting knives in fine gauge cut pile tufting machines. The knife block has a pair of longitudinally extending spaced flanges connected together by a pair of laterally spaced apart web portions spaced longitudinally from each other. At least one knife is adapted to be received between the flanges intermediate the webs, and at least one knife is adapted to be received between the flanges laterally outwardly of each web. A method of making the knife block is also disclosed as including the steps of cutting at least one pair of knife receiving grooves in the flanges in the lateral space between the webs by feeding a rotating cutting blade from one extremity of the block substantially to the inner edge of one web and then turning the block and feeding the cutter from the other extremity to form at least one continuous knife receiving groove extending the full longitudinal width of the flanges.

10 Claims, 7 Drawing Figures

KNIFE BLOCK FOR TUFTING MACHINES

BACKGROUND OF THE INVENTION

This invention relates generally to tufting machines for forming fine gauge cut pile fabric and more particularly to improved knife blocks for mounting the knives in such machines and to the method of producing the knife blocks.

In cut pile tufting machines an oscillating knife cooperates with an oscillating hook or looper to cut the loop of yarn that has been seized by the looper from a corresponding needle. It is conventional in such machines for the knife to be supported and retained in a knife block carried by an oscillating knife bar. Examples of the known knife blocks are illustrated in Card U.S. Pat. No. 3,277,852; Cobble et. al. U.S. Pat. No. 3,386,398; Cobble U.S. Pat. No. 3,604,379; and Bonner U.S. Pat. No. 3,788,245. However, each of these patents discloses a knife block limited to mounting one or two knives only. In the aforesaid patents illustrating the mounting of two knives, the knives are received in side by side relationship in two longitudinal channels spaced apart by a central longitudinal web formed generally integral with a pair of longitudinally extending oppositely facing spaced flanges undercut to form grooves. The grooves together with the surfaces of the web define the knife receiving channels. The thickness of the web provides the required structural strength to the knife blocks to resist twisting and bending when the knives are positioned and secured in the channels.

The gauge of a pile fabric is determined by the spacing between adjacent gauge parts, i.e., the needles, loopers and knives. Thus, the spacing between a pair of knives mounted in a knife block is a measure of the gauge of the cut pile fabric produced. In fine gauge cut pile fabric, i.e., 1/10 gauge and smaller, the spacing between a point on one knife to the corresponding point on an adjacent knife is respectively 0.1 inch and smaller. Thus, in the two knife receiving knife blocks of the prior art the thickness of the web to accomodate a knife of a 1/10 gauge machine would be 0.1 inch minus the thickness of one knife. Moreover, the thickness of the entire block is such that the shaft supporting the block in the oscillating knife bar is too small to support the load on the block and tend to break by shearing. Furthermore, the location of the knife bar and the proximity of the adjacent blocks makes the assembly of the multiplicity of blocks difficult. One theoretical solution for obtaining a larger block supporting shaft is to mount two or more knives on each side of the central knife block web. However, the extremely thin web section results in excessive bending and twisting of the web upon insertion and assembly of replacement knife blades into a block remaining in the machine.

SUMMARY OF THE INVENTION

The present invention overcomes these problems of the prior art knife blocks by providing a knife block having a pair of laterally spaced apart web members having knife receiving channels formed between and outwardly of each web. The blocks include oppositely facing grooved longitudinally extending flange portions spaced apart by the laterally spaced apart web members, each of which extends from flange to flange, but neither of which extends the full longitudinal length of the flanges so that a longitudinal space is formed between the webs and extends substantially normal to the planes of the webs, whereby at least one knife receiving longitudinal channel may be formed between said web members. The two spaced apart webs couple to resist the bending and twisting forces so that knife blocks capable of mounting three or more knives are practicable.

Another feature of the invention resides in the method of manufacturing a knife block having laterally spaced apart webs extending from one longitudinally extending flange of the block to the other longitudinally extending flange so that at least one knife may be mounted in a channel formed between the webs. The methods includes the steps of forming each web so that a longitudinal space exists between the webs, and thereafter cutting at least one groove from flange to flange laterally between the webs from one extremity of the block to a location within the longitudinal space between the webs, and then turning the block and cutting the remainder of the groove from or to the other extremity of the block.

It is therefore a primary object of the present invention to provide an improved knife block for cut pile tufting machines wherein each block may mount three or more cutting knives.

It is another object of this invention to provide a knife block for cut pile tufting machines having a pair of lateral spaced apart web members each having a length that is less than the longitudinal length of the block, the lateral space between the webs providing at least one longitudinally continuous knife receiving channel and the exterior of each web providing at least one continuous longitudinal channel.

A further object of this invention is the provision of a method for manufacturing cut pile tufting machine knife blocks having at least three knife receiving channels, at least one channel being formed between a pair of laterally spaced apart webs.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE INVENTION

Figure 1:
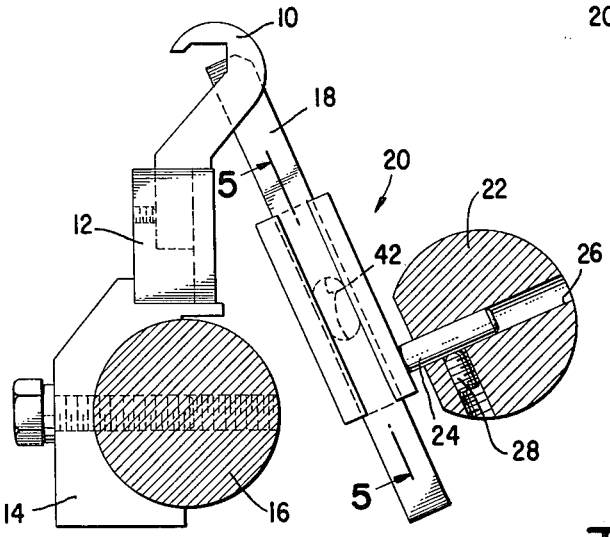
FIG. 1 is a side sectional elevational view taken through a hook and knife shaft of a conventional cut pile tufting machine, and disclosing a knife block incorporating the present invention.
Figure 3:
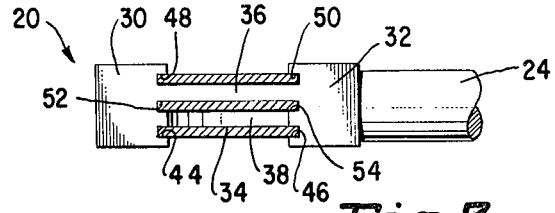
FIG. 3 is a top plan view of the knife block illustrated in FIG. 2 with the knives in section.
Figure 4:
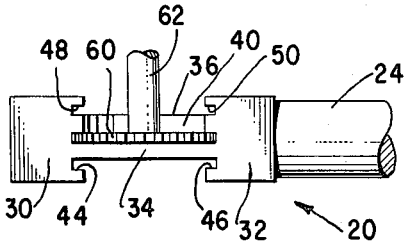
FIG. 4 is a bottom plan view of the knife block illustrated in FIG. 2 illustrating a step in the method of manufacturing the block.

Referring to FIG. 1, a tufting machine hook or looper 10 is shown as being supported in a looper block 12 which is in turn supported by a block support 14. The block support 14 is suitably bolted to a rock shaft 16 for rocking the looper 10 back and forth for picking up a loop of yarn from a needle (not shown) in a known manner. In cut pile machines the looper 10 is generally rocked or oscillated into position for cooperating with a knife mechanism in timed relationship for cutting the loop of yarn to form cut pile.

In order to carry out this objective, a plurality of cutting knives 18 are carried by a series of knife blocks generally indicated at 20. Each knife block in turn is supported on a rock shaft 22 by means of a support shaft or stud 24 integral with the block and received within a bore 26 within the shaft 22 and secured by a set screw 28 or the like. The knife blocks are thus oscillated by the rock shaft 22 back and forth into cutting engagement with the yarn on the looper.

Referring now to FIGS. 2–5, it will be seen that a knife block 20 constructed in accordance with the present invention comprises a pair of longitudinally extending flanges 30 and 32 connected together by a pair of webs 34 and 36. The webs preferably extend normal to the flanges, and lie in parallel planes spaced apart laterally from each other. Each of the webs 34 and 36 extends between the flanges 30 and 32, but neither of the webs extends the full longitudinal length of the flanges.

Figure 5:
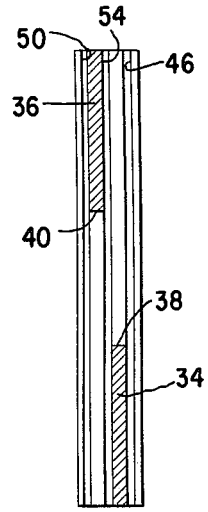
FIG. 5 is an elevational cross sectional view of the knife block illustrated in FIG. 2 taken substantially along line 5—5 of FIG. 1 through the center of both webs.
Figure 2:
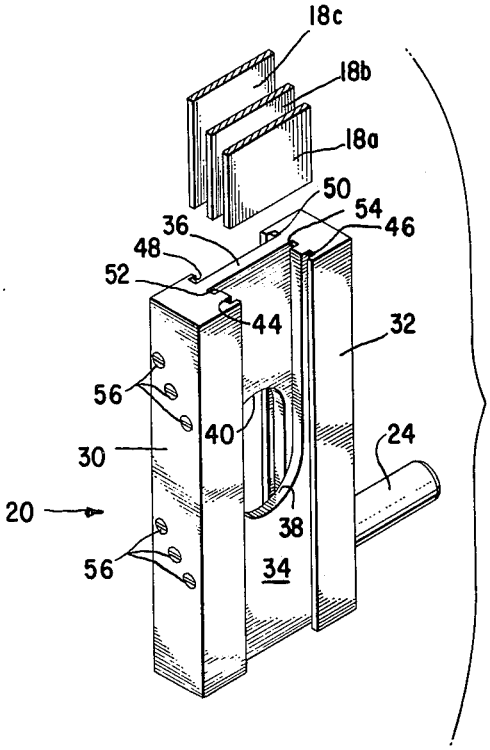
FIG. 2 is a perspective view of a three knife mounting knife block constructed in accordance with the present invention and illustrating three such knives partially broken away.

As best illustrated in FIGS. 2 and 5, the web 34 preferably extends from the bottom extremity of the flanges longitudinally upwardly to an inner edge 38, while the web 36 preferably extends from the top extremity of the flanges longitudinally downwardly to an inner edge 40. The edges 38 and 40 and thus the webs 34 and 36 terminate at locations such that they are longitudinally spaced apart. In the preferred construction the longitudinal spacing between the web defines an elongated slot 42, illustrated in FIG. 1, which extends transversely substantially normal to the planes of the webs. Again, in the preferred illustrated construction the slot 42 is substantially midway between the outer extremities of the webs. However, it should be understood that the webs may terminate at other locations but that the edges should be spaced somewhat longitudinally such that a plane normal to the planes of the webs and to the flanges will intersect no more than one of the webs, although it may not intersect either of the webs.

The longitudinal spacing between the webs provides an economical and practical construction of the knife receiving channels laterally between the webs. Conventionally, knives are received within channels formed by undercutting grooves into the flanges adjacent each side of the single web members of the prior art. The present invention not only provides for such channels adjacent the outer wall of the webs 34 and 36, but also provides for knife receiving channels between the two webs of the present invention. Thus, in the embodiment of FIGS. 2–5 not only may knife receiving channels be formed by undercutting grooves 44 and 46 in the respective flanges 30 and 32 outwardly of the web 34, and by undercutting grooves 48 and 50 in the respective flanges 30 and 32 outwardly of the web 36, but at least one knife receiving channel may be formed laterally between the webs 34 and 36 by cutting at least one pair of grooves 52 and 54 respectively in the flanges 30 and 32. Consequently, knives 18, **18*a*, and 18*b* may be received between the respective pair of grooves 44–46, 52–54, and 48–50. Obviously, the flange to flange width of the grooves is substantially the same as the corresponding width of the knives so that the knives may be slidably received between the flanges. Means such as set screws 56, on either one or both flanges 30, 32** may retain the knives in position. As illustrated, the set screws may be staggered longitudinally to conserve space and provide for screws of sufficient diameter to retain the blades.

The principles of the present invention are not limited to a three knife holding block, but may be applied to blocks for holding a multiplicity of knives. For example, FIGS. 6 and 7 illustrate the principles applied to knife blocks for supporting five and four knives respectively.

Figure 6:
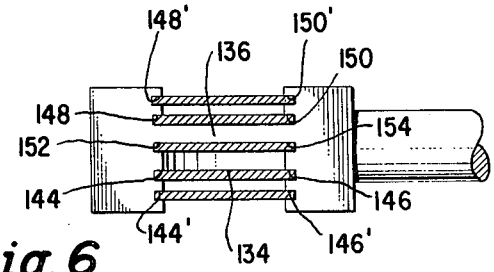
FIG. 6 is a top view similar to that of FIG. 3, but illustrating a knife block for mounting five knives constructed in accordance with the principles of the present invention.

The block illustrated in FIG. 6 is similar to that of FIGS. 2–5 in that only one knife receiving channel is formed laterally between the webs 134 and 136 by means of the grooves 152–154. However, besides the first pair of grooves 144–146 adjacent the lateral exterior of the web 134, a second pair of grooves 144'–146' may be formed, and smilarly a second pair of grooves 148'–150' may be formed laterally adjacent the first set of grooves 148–150 adjacent the lateral exterior of the web 136. The resistance offered to bending and twisting by the provision of two webs, allows for these and other additional laterally exterior grooves.

Figure 7:
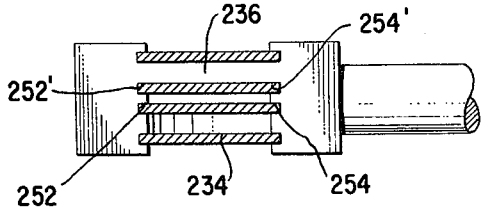
FIG. 7 is a top plan view similar to that of FIG. 3, but illustrating a knife block for mounting four knives constructed in accordance with the principles of the present invention.

In FIG. 7 a knife block for supporting four knives is illustrated having two knife receiving channels formed intermediate the webs 234 and 236. The block is similar to the embodiment of FIGS. 2–5 except for the addition of a second pair of grooves 252'–254' laterally between the webs and adjacent the first pair of grooves 252–254. It should thus be understood that knife blocks having many channels laterally between the two webs, and many channels laterally externally of the two webs is made possible by the principles of the present invention.

In order to construct knife blocks of the present invention, it is necessary to cut at least one pair of grooves in the flanges between the webs. To this end the webs, for example 34 and 36 in FIGS. 2–5 terminate at the respective inner edges 38 and 40 so that a cutter such as a rotary disc-type cutter having a cutting blade 60 rotating about a shaft axis 62 substantially normal to the planes of the web, may be relatively fed in the longitudinal direction, laterally between the webs to form the grooves 52 and 54. Thus, the cut may be initiated at one extremity of the flanges with the shaft 62 of the cutter extending outwardly where there is no web, and progress until the inner edge of the web prevents further cutting. The block or cutter may thereafter be turned to reorient the cutter relative to the block for cutting the remainder of the grooves in the flanges.

For example, the grooves 52–54 in FIGS. 2–5 may be cut by initiating the cut at the top adjacent web 36 so that the shaft 62 will face laterally outwardly of web 34. When the blade reaches the vicinity of the slot 42 so that the shaft 62 will thereafter be interferred with by the edge 38 of web 34, the blade is removed from the grooves and the blade or block is turned so that the blade may be set to cut from the bottom adjacent web 34 with the shaft extending outwardly away from the web 36. Any number of grooves may be cut between the webs in this manner — either by cutting them one at a time or by gang cutting. The longitudinal spacing between the webs allows for the thickness of the shaft 62 so that the grooves may be cut the entire longitudinal length of the block. The longitudinal spacing between the webs, however, need not be very great — only enough to allow for a full longitudinal cut. Practically however, the larger the spacing the easier the operation.

Numerous alterations of the structure and method herein disclosed will suggest themselves to those skilled in the art. It is to be understood that the present disclosure relates to preferred embodiments of the invention which are for purposes of illustration only and are not to be construed as a limitation of the invention. All such modifications which do not depart from the spirit of the invention are intended to be included within the scope of the appended claims.

Having thus set forth the nature of the invention, what is claimed herein is:

1. A knife block for a tufting machine comprising an elongated body member having a pair of longitudinally extending spaced flange portions, said flange portions being connected together by a pair of webs, said webs being laterally offset from and parallel to each other, said webs further being longitudinally offset from each other such that any plane extending substantially normal of the planes of said webs and to said flange portions intersects no more than one of said webs, means for slidably receiving at least one cutting knife between said flange portions laterally outwardly of each web, and means for slidably receiving at least one cutting knife between said flange portions laterally intermediate said webs.

2. A knife block as recited in claim 1 wherein the longitudinal offset between said webs defines an elongated slot extending substantially normal to the planes of said webs.

3. A knife block for a tufting machine comprising an elongated body member having a pair of spaced flange portions extending longitudinally and defining the outer extremities of the body member, said flange portions being connected together by a pair of laterally spaced apart web portions, each of said web portions extending longitudinally from an inner edge to an outer extremity, the inner edges being longitudinally spaced one from the other, means defining at least one pair of aligned facing grooves in the flanges adjacent each web laterally remote from the other web for slidably receiving a cutting knife in each pair of grooves, and means defining at least one pair of aligned facing grooves in the flanges laterally intermediate said web portions for slidably receiving a knife in each pair of grooves.

4. A knife block as recited in claim 3 wherein the outer extremities of said web portions are substantially coextensive with the corresponding extremity of the flange portions.

5. A knife block for a tufting machine comprising an elongated body member having a pair of longitudinally extending spaced flange portions, said flange portions being connected together by a web having first and second laterally facing sides, said web having at least one longitudinally extending slot formed laterally intermediate said sides from flange to flange to define two web portions for slidably receiving one cutting knife in each slot, and means for slidably receiving at least one cutting knife between said flanges adjacent each of said first and second sides.

6. A knife block as recited in claim 5 wherein each of said web portions extends from an inner edge intermediate the extremities of said flanges longitudinally to a different one of the extremities of said flanges, the inner edge of one web portion being spaced longitudinally from the inner edge of the other web portion.

7. In a tufting machine having looper means for seizing loops from a yarn carrying needle and a cutting apparatus for cutting the loops of yarn seized by said looper means, said looper means including a multiplicity of oscillating loopers, each having one edge thereof forming a cutting edge, said cutting apparatus including a cutting knife corresponding to each looper and having a cutting edge disposed for cooperation with the cutting edge of the corresponding looper, means for initiating relative oscillating motion between said loopers and said knives such that the cutting edges on said loopers and said knives cooperate to cut a loop disposed on said loopers, said cutting apparatus further including a multiplicity of knife supporting blocks, each of said blocks comprising an elongated body member having a pair of longitudinally extending spaced flange portions connected together by a pair of laterally spaced apart parallel webs, said webs being longitudinally spaced apart such that any plane extending substantially normal to the planes of said webs and to said flange portions intersects no more than one of said webs, means for slidably receiving at least one knife between said flange portions laterally intermediate said webs and means for slidably receiving at least one knife between said flange portions laterally outwardly of each web, and means for clamping said knives in said block.

8. The method of manufacturing a knife block having a pair of longitudinally extending spaced flange portions connected together by a pair of laterally spaced apart webs such that at least one pair of knife receiving grooves may be formed in said flange portions laterally intermediate said webs, said method comprising:

a. removing a portion of each web from a different longitudinal extremity to an inner edge of the web, the inner edges of said webs being longitudinally spaced one from the other, b. cutting at least one pair of longitudinally extending grooves in the flange portions laterally intermediate said webs from one extremity of the block to a location within the longitudinal space between the webs adjacent the inner edge of a first web by cutting from the extremity from which the portion of the first web has been removed, and c. continuing to cut said at least one pair of longitudinally extending grooves by cutting from the other extremity of the block to adjacent the inner edge of the second web.

9. In the method as recited in claim 8 wherein said steps of cutting each pair of grooves comprise abutting both flange portions with a rotating disc-type cutting blade having an axis of rotation substantially normal to the planes of said web, and relatively feeding said blade and said block to progressively cut from the extremity toward the inner edge of the webs.

10. In the method as recited in claim 9 including the step of relatively reorienting the block and the blade after cutting to adjacent the inner edge of said first web, and thereafter cutting from said other extremity.

* * * * *